United States Patent [19]

Fiore

[11] Patent Number: 4,603,856

[45] Date of Patent: Aug. 5, 1986

[54] EXERCISING DEVICE

[76] Inventor: Russell D. Fiore, 9 Raymond St., Lincoln, R.I. 02865

[21] Appl. No.: 656,958

[22] Filed: Oct. 2, 1984

[51] Int. Cl.[4] ..... A63B 21/00

[52] U.S. Cl. ..... 272/131; 272/143

[58] Field of Search ..... 272/67, 131, 132, 134, 272/117, 143, 140, 146; 248/278; 403/54, 56; 128/25 R

[56] References Cited

U.S. PATENT DOCUMENTS

| | | | |
|---|---|---|---|
| 1,535,391 | 4/1925 | Anderson | 272/132 |
| 2,460,880 | 2/1949 | Geizer et al. | 403/54 |
| 2,817,524 | 12/1957 | Sadler | 272/132 |
| 3,428,311 | 2/1969 | Mitchell | 272/132 X |
| 3,637,205 | 1/1972 | Bankston | 272/131 X |
| 3,768,808 | 10/1973 | Passera | 272/132 |
| 3,782,721 | 1/1974 | Passera | 272/132 |
| 3,971,255 | 7/1976 | Varney et al. | 272/131 X |
| 4,026,279 | 5/1977 | Simjian | 272/146 X |
| 4,249,727 | 2/1981 | Dehan | 272/132 |
| 4,502,681 | 5/1985 | Blomqvist | 272/117 X |

FOREIGN PATENT DOCUMENTS

| | | | |
|---|---|---|---|
| 2152399 | 4/1973 | Fed. Rep. of Germany | 272/131 |

*Primary Examiner*—Richard J. Apley
*Assistant Examiner*—Robert W. Bahr
*Attorney, Agent, or Firm*—Robert J. Doherty

[57] ABSTRACT

An upper extremity exercising device including a shaft fixed at its lower end adjacent a support for the exerciser's shoulder. The lower end of the shaft is supported for universal movement such that the shaft may simultaneously transcribe arcs simulating the shoulder motion of the exerciser. The lower end of the shaft includes a lower resistance unit and the upper end includes an upper resistance unit adapted to be hand gripped by the exerciser and longitudinally slidable on the shaft. The resistance to motion of each resistance unit can be varied to suit a wide range of exercise modes.

20 Claims, 21 Drawing Figures

10
12
30
32
34
90
140

FIG. 15
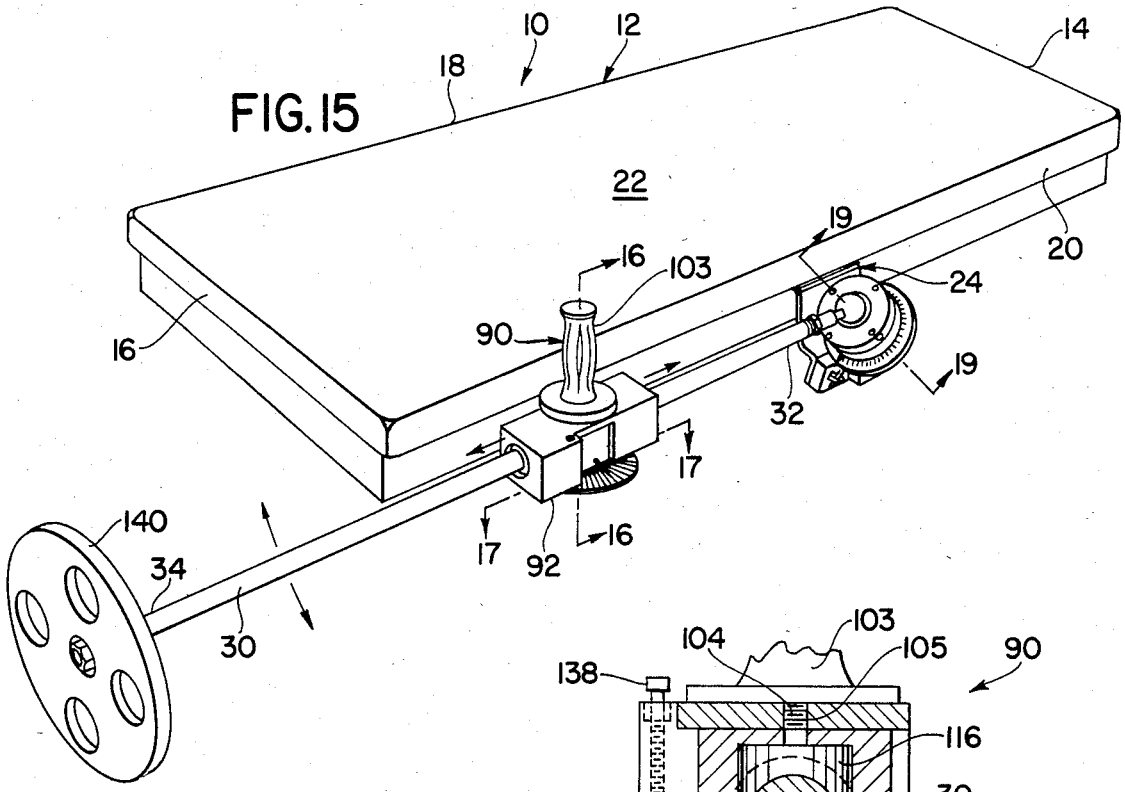
FIG. 16
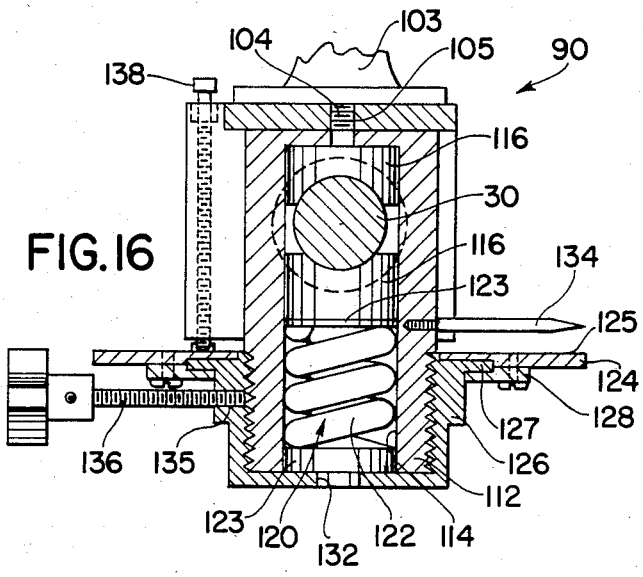
FIG. 16a
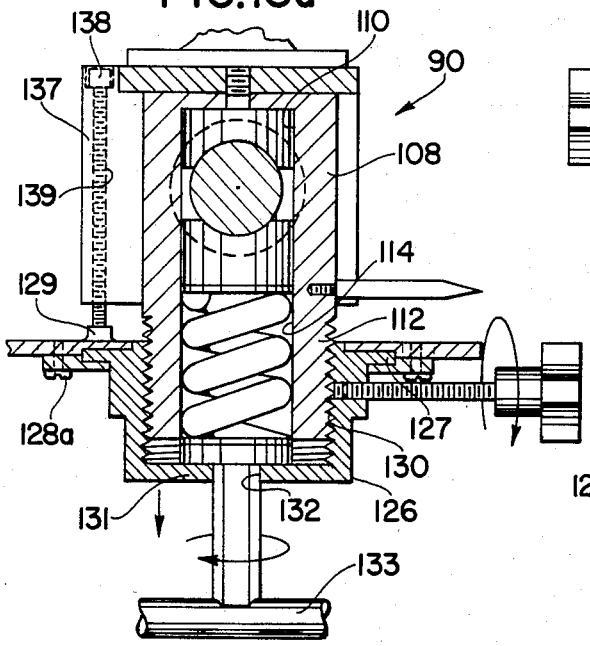
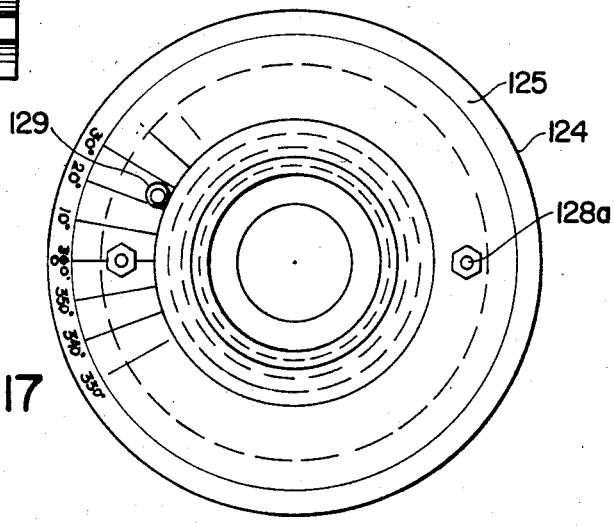
FIG. 17

EXERCISING DEVICE

BACKGROUND AND OBJECTS OF THE INVENTION

This invention relates to an exercising device and more particularly to a device which has utility in exercising a great many of the muscles and muscle groups of the human upper extremity and in particular the shoulder area thereof.

In the biomechanics of human shoulder function, there are four joints which contribute to the shoulders functional motion. They are the scapulo-thoracic, gleno-humeral, acromio-clavicular, and the sterno-clavicular. Each time the shoulder moves motion takes place in more than one of these joints. Of these the gleno-humeral and the scapulo-thoracic are responsible for the greatest amount of motion at the shoulder.

Together these joints are responsible for approximately the following amounts of motion: 180 degrees of flexion in the sagittal plane, 60 degrees of extension in the sagittal plane, 180 degrees of abduction and adduction in the frontal plane, 90 degrees of external rotation in the sagittal plane, and 90 degrees of internal rotation in the sagittal plane.

Movements of the arm at the shoulder are free, and include flexion, extension, abduction, adduction, circumduction, internal rotation, and external rotation. These movements are usually defined in relation to the body as a whole. Flexion of the shoulder is a forward movement of the arm. Extension, the reverse of this, is backward movement of the arm. Abduction is the movement of raising the arm laterally away from the body; adduction, the opposite of this, is then bringing the arm toward the side. Circumduction is a combination of all four of the above defined movements, so that the hand describes a circle. Internal rotation is a rotation of the arm about its long axis, so that the usual anterior surface is turned inward toward the body; external rotation is the opposite of this.

All movements of the arm at the shoulder can be described by the terms used above, although usually movements of the arm are combinations of two or more of the above defined movements with a multiaxial axis and plane of motion. Thus, for example, in bringing the arm across the chest in throwing an object we both flex and adduct the shoulder and usually also internally rotate it at the same time. In scratching the lower part of one's back, one extends, internally rotates, and abducts or adducts.

Over twenty major muscles cross at least one and in many cases more than one of the joints listed above on each shoulder. Their function is to create motion, and thus the ability to do work with the upper extremity. To perform a given task with precision, power, strength, endurance, and coordination, all of these muscles must be well conditioned.

Some of the shoulder muscles included are the supraspinatus, infraspinatus, teres minor, deltoid, anterior deltoid, posterior deltoid, biceps, long head of biceps, short head of biceps, upper and lower pectoralis major, subscapularis, teres major, coracobrachialis, latissimus dorsi, triceps long head. Some of the scapular muscles included are the serratus anterior, upper and lower trapezius, major and minor rhomboids, levator scapulae, and pectoralis minor.

The function of each of these muscles depends on its relative position to the joint axis it crosses, the motion being attempted, and any external stresses acting to affect motion. It is well accepted that muscles rarely act singly, rather, groups of muscles interact in many ways so that a desired movement can be accomplished. The interaction of muscles may take many different forms so that a muscle serves in a number of different capacities, depending on movement. At different times a muscle may function as a prime mover, antagonist, or a fixator or synergistically as a helper, a neutralizer or a stabilizer. Most of these muscles are continually active with any type of freely rotational shoulder movement as their role continually changes.

Biochemically the shoulder functions almost always along with the elbow. In activities of daily living and in recreational sports upper extremity movement requires synergy between these two areas. The shoulder and elbow move together although independent of one another in performing all complex activities. In order to optimally train and exercise the shoulder one must also train and exercise the elbow at the same time. In this way, the upper extremity is treated as a functional unit. All joint motions and muscle functions would be coordinated together.

There are three major joints which contribute to elbow function. They are the ulnar-humeral, radio-humeral, and the radio-ulnar. The ulnar-humeral is responsible for 135 degrees of flexion and extension while the radio-humeral and the radio-ulnar joints are responsible for 90 degrees of supination and 90 degrees of pronation. Flexion is movement in the anterior direction from the position of straight elbow, zero degrees to a fully bent position. Extension is movement in a posterior direction from the fully bent position to the position of a straight elbow. Supination and pronation are rotational movements of the forearm. Supination is with the palm up and thumb rotated laterally. Pronation is with the palm down and thumb rotated medially.

Over twelve major muscles effect motion at each elbow. These are the biceps, brachialis, brachioradialis, supinator, extensor capri radialis longus, pronator teres, flexor carpi radialis, palmaris longus, flexor carpi ulnaris, triceps, anconeus, supinator, pronator quadratus. Of these, the biceps anteriorly, an elbow supinator and flexor, and the triceps posteriorly, an elbow extensor also cross the shoulder. Like the shoulder muscles, these elbow muscles are continually active as there role changes in performing the complex activities of daily living, work, and recreational sports.

An in depth review of the biomechanics of the shoulder and elbow show a variety and considerable number of muscles and articulations whose combined function result in great strength and precision of movement anywhere in the range of motion. Each component muscle and joint has a unique function depending on the motion being attempted. In order to fully train and strengthen upper extremity musculature, one must use this biomechanical knowledge and work in all planes, patterns, and extremes of motion exercising the body part as it will function. Only in this way can total neuromuscular balance, coordination, and proprioception be achieved.

Known types of upper extremity exercise and/or exercise devices include isometric, isotonic, isokinetic, and special cases.

Isometrics is an exercise done without any joint motion taking place. The hand would be pressed against an immovable object such as a wall. Strength can be improved but only in the range of motion in which it is being exercised. Since only one position and one angle can be used at one time, this becomes a time consuming approach if one tried to exercise throughout all points in the range of motion of the shoulder and elbow. This also cannot be considered a functional exercise since the upper extremity rarely moves against an immovable object.

Isotonic exercises are done against a movable resisting force. The resisting force is usually free weights. This is probably the most common method of exercise for the upper extremity as it is relatively inexpensive and readily available in gyms. A weight is held in the hand and moved in opposition to gravity. It is a functional advantage to be able to move through a full range, but because of this gravitational effect on the weight, body position must be continually changed for all muscles to be exercised. In the backlying or supine position, a weight held in the hand and pushed straight up vertically (bench press position) exercises the anterior chest and posterior upper arm muscles. In order to exercise the posterior shoulder and the anterior arm muscles, one would have to switch to a facelying or prone position and pull the hand held weight upward again against gravity. The time commitment here becomes a disadvantage as does ones having to make changes in the amount of free weight used in order to afford a smooth progressive overload. In this form of exercise, the load remains constant and the amount of stress on the muscle will vary. The most difficult point in the range is the initial few degrees with a movement to overcome inertia. The other disadvantage occurring here is one of leverage. As the upper extremity comes closer to the vertical position. leverage with respect to the joint increases and work becomes easier. This also creates a variability in the degree of muscle tension throughout the range of motion. Isotonic exercises can be performed on Nautilus, Universal Gym and other similar machines which achieve a more uniform resistance. Again body position must be changed to affect different muscles. This is achieved by moving on to a different apparatus. A major disadvantage is that motion on these machines is confined to a straight plane movement without deviation which is not how the biomechanical components of the upper extremity are used.

Isokinetic exercise involves a constant speed and a variable resistance. There are many hydraulic (Orthotron by Cybex), electromechanical (Cybex by Cybex division of Lumex), and pneumatic (Kessler) isokinetic units on the market. These are all limited to one straight plane at a time as with Universal and Nautilus. The advantage with these isokinetic devices is that resistance is in either direction of the single place of movement, i.e., flexion and extension of the shoulder, without changing body position. The isotonic Universal and Nautilus afford resistance only in one direction against gravity before changing body position. On exercise machines by Cybex, Hydragym, Kessler, etc. (isoKinetic straight plane machines) either the axis of motion, one's body position, or the apparatus itself must be changed to affect a variety of musculature in the shoulder and elbow. These machines are not functional to the biomechanics of the upper extremity since motion cannot take place through different planes simultaneously. A recently developed shoulder hydraulic isokinetic exerciser by Isotechnologies does allow simultaneous motion through planes of shoulder motion but, as with other isokinetic machines, will not allow any functional independent elbow exercise to occur simultaneously along with shoulder motion. Therefore this is not a biomechanically sound approach for the upper extremity.

Included in special cases are the wall pulley, frictional and elastic resistance exercise devices for the shoulder. They will be considered together because their axis of motion is stationary, their resistance direction is uniaxial and the effective line of pull straight plane. These are similar to isotonic unidirectional resistance methods with the exception that here the axis of motion or height of the wall pulley or hook for fastening an elastic band may be changed in order to affect different muscle, while the line of pull of gravity cannot be changed therefore one's body positioning must be changed with isotonic-free weights.

Like with hand held free weights, the major advantage is the upper extremities full range of motion through exercise. The drawback for this functional range of shoulder and elbow motion is unidirectional resistance, fixed axis, and only one resistance for both the shoulder and elbow. The elbow being a smaller joint with less cross sectional muscle will require less resistance than the shoulder. When using one resistance for both joints of the upper extremity, the weaker of the two joints would limit and determine the resistance setting for the whole extremity.

Despite the availability of the above devices and exercise types, there remains a need for a device which both accomplishes the advantages of known devices but yet eliminates their drawbacks. Such objects are accomplished by the present invention in the form of a device which is compact, simple to utilize and of relative low cost. Such device is referred to as the Multiaxial Upper Extremity Exerciser (MUEE). Mechanically the Multiaxial Upper Extremity Exerciser (MUEE) functions as a three joint frictional resistance exerciser. Friction provides for smooth gliding movements in all joints at all resistance settings. Resistance is adjustable from very little to extremely high loads. All resistance is calibrated and measured in a convenient scale such as pounds or footpounds. This calibration allows for recording of progress and for ones working with uniform resistances from day to day. Once resistance as been set, it may remain constant or become variable depending on the speed of motion.

The present device includes upper and lower resistance systems which cooperate with each other to achieve the overall results and flexibility of the device. The lower resistance system may include two multiaxial friction joints. These joints allow for a full range of motion in the gleno-humeral, scapulothoracic, acromioclavicular, and costo-clavicular joints. The upper frictional resistance joint which glides and rotates along the shaft attached to the top joint of the lower frictional resistance system allows for full elbow flexion, extension, pronation, and supination. Both the upper and lower resistance systems have independent resistance settings. This allows for less resistance to be used at the elbow than at the shoulder which is more demanding. Resistance can be fine tuned depending on the specific requirements of the extremities' component parts at that point in time.

The design and placement of this three-axis, mechanical system allows the shoulder and elbow to move through a full range of motion between all planes independently and simultaneously with synergy as one functional unit, as it acts biomechanically. Any straight plane, diagonal, or multiaxial movement at the shoulder can be accompanied by any related elbow motion.

Upper extremity work can be done in all planes, patterns, and extremes of motion at the same time on this device. Over twenty shoulder and twelve elbow muscles can be coordinated together. This is a functional exercise device causing group activity in the upper extremity musculature as it trains the motor units to act in all the ways it can be used in activities of daily living, work, or in recreational sports. This complete upper extremity exercise system provides comprehensive improvement in neuromuscular balance, strength, power, endurance, and coordination through a full range of motion. This will decrease the chance of injury or reinjury to the upper extremity.

With the MUEE, the total upper extremity musculature can be effectively conditioned without having to make changes in body position or exercise axis. This allows exercise regimes to be completed quickly as does the fact that resistance is multidirectional and follows any joint movement. Once the resistance is set, it will work in all directions without needing to be reset for the return motion. Exercise regimes may be designed therapeutically for the post traumatic, atrophied, stiff, and painful extremity or for high levels of complete sports conditioning.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 15 is an overall perspective view of that device;

FIG. 16 is a sectional view taken along the line 16—16 of FIG. 15 and shows the upper resistance or handle unit in particular;

FIG. 16*a* is a sectional view similar to FIG. 16 but showing the upper resistance or handle unit having been rotated 360 degrees to an open or easily slidable position;

FIG. 17 is a plan view taken along the line 17—17 of FIG. 15;

DETAILED DESCRIPTION OF THE INVENTION

Figures 1, 2, 3, 4, 5, 6, 7, 8, 9, 10, 11:
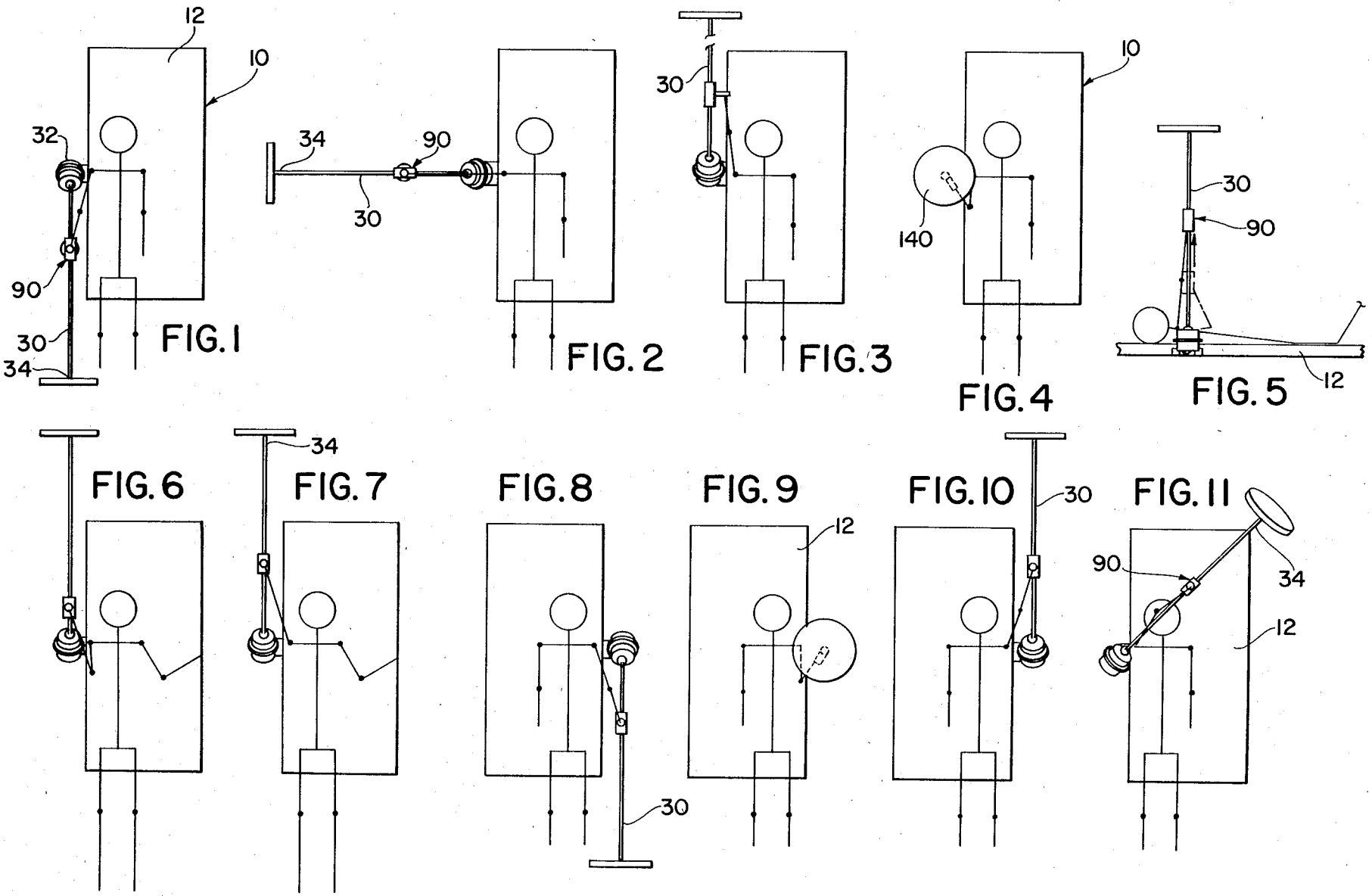
FIGS. 1–14 are schematic illustrations showing different exercise modes or positions in which the device of the present invention may be utilized.

Turning now to the drawings, the device 10 of the present invention is particularly although not necessarily adapted for use in conjunction with a lowlying bench 12 of conventional construction having opposed ends 14, 16, and sides 18, 20, and exhibiting a substantially planar upper surface 22 adapted to support the upper body portions of an exerciser in prone, supine, and other related positions when utilizing the device.

The device 10 is connected to the bench 12 at one side 20 thereof approximately midway between the ends 14 and 16 thereof by means of a connector system 24 attached to the bench frame (not shown) and including an upwardly extending shaft 26 terminating in a connecting ball element 28. This midway positioning of the device relative to the bench enables the exerciser to work on either right or left extremity by simply turning around, that is, alternating head to toe his or her position on the bench. The position, height, and angular relationship of such ball element to the bench 12 is such that the overall device 10 will be conveniently placed with respect to the exerciser in position upon the bench surface 22 when connected to the system 24 including the first ball element 28.

The overall configuration of the device 10 includes an elongated shaft 30 preferably of circular cross-sectional configuration which includes a lower end 32 and an upper end 34. The lower end is connected to the ball element 28 and connector 24 such that the shaft is capable of multiaxial movement including at least 180 degrees in a lateral plane circumscribed by generally horizontal movement of the shaft 30 (such plane is generally parallel to or defined by the plane passing through the generally planar surface 22 of the bench 12) and a vertically oriented plane substantially normal to said first plane and that of the bench surface 22. The connection at the lower end 32 of the shaft is such that various intermediate movements between such planes, circular movement and generally multiaxial movement with respect to the bench is permitted. In essence, the movements previously described in connection with the elbow and shoulder on Pages 1–5 hereof are afforded by the MUEE device.

Such connection is brought about by means of the threaded interconnection of an upper housing segment 36 with a lower housing segment 38. The lower housing segment 38 includes a circular adjustable plate 39 having an upper surface 40 which is delineated by suitable degree markings to indicate th relative force needed to move the shaft 30 with respect to its lower end 32 and connector 24 when appropriately assembled and adjusted. The plate 39 is connected to a downwardly extending hollow boss portion 44 which is internally threaded along a central bore 46 by means of a plate 41 via screws 42. The boss 44 includes a flange 43. The plates 39 and 41 are positioned on opposite sides of the flange 43. By removing the screws 42, the relative positioning of the plate 39 and its indicia provided upper surface 40 is brought about. The upper surface of plate 39 is also provided with an upwardly projecting stop 47. Such central bore 46 connects with a end bore 48 of a dimension to accept passage of the ball element 28 therethrough. The lower bore 48 is inwardly stepped at 50 and provided with a keeper ring 51.

The shaft lower end terminates in a second ball element 52 which is adapted to be housed within the upper housing segment 36 which in turn includes an upper ring-like portion 54 having an internal bore 56 large enough to receive the second ball element 52 and a step 58 to position a keeper ring 60. A second or lower ring-like portion 62 is suitably connected to the upper portion 54 by bolts 64. One of the bolts 64 is longer than the others and projects downwardly toward the plate 39 such that it contacts the stop 47 and in this way is used to limit the relative rotation of the upper and lower segments 36, 38 to 360 degrees. A pointer 65 radially projecting from the portion 62 serves to record the relative movement of the segments 36, 38.

The portion 62 includes an internal bore 66 of a diameter adapted to receive disc-shape brake elements 68 snugly therein. Such brake elements may be formed from any suitable material including commercially available asbestos fiber material and include an upper concave face 70 adapted to conform to th outer surface of the ball elements 28 and 52 and a rear surface of essentially flat configuration. Such rear surfaces 72 are disposed in opposition to each other. Spring means preferably in the form of a pair of Belleville springs 74 are disposed between the rear surfaces 72 to insure an inherent spring action to force the braking surfaces 70 into engagement with the ball elements when the upper and lower housing segments 36, 38 are moved relative to each other.

To facilitate such action, the lower portion 62 of the upper housing segment 36 includes a downwardly extending outwardly threaded boss 76 which is adapted to threadably engage the threaded bore 46 of the boss 44. As can be seen, the relative movement between such housing segments progressively forces the braking elements 68 into tighter engagement with the ball elements 28 and 52 and, accordingly, provides the variable resistance movement that is a feature of the present device. When the desired resistance has been reached by such relative movement of the housing segments, a set screw 78 having a handle 80 which passes through a threaded bore 82 provided in the boss 44 may be engaged such that it jams the threads of the boss 76 and permits no further relative further movement between the housing segments 36 and 38. Circular turning movement of the plate 39 may be brought about either by direct hand manipulation of the plate itself or by manipulation of a wrench 81 around the outer surface of the boss 44 which may engage plug openings 84. The upper ring-like portion 54 is provided with similar openings 85 such that it may be held in position while the boss 44 is rotated. Thus in this way, the upper and lower housings may be moved towards an away from each other such that greater or lesser pressure is brought to bear between the concave surfaces or braking surfaces 70 of the brake elements 68 and the ball elements 28 and 52 and by setting the set screw 78 so that such position is retained, the user may place the desired amount of resistance force required to be overcome at the shaft lower end 32 and thus regulate the strength required to conduct various exercises as will hereinafter be more evident. The lower resistance unit is thus formed by the above-described coaction between the shaft lower end and the housing formed by the upper and lower housing segments.

The upper resistance or handle unit 90 includes a bifurcated body 92 having first and second body portions 94 and 95 connected by a central web 96 and separated from each other centrally by an open portion 98. Both of the body portions 94 and 95 include an internal bore 100 provided with bearings 102 such that the body 92 is free to both slide and rotate upon the shaft 30. The body 92 further includes an outwardly extending handle or grip 103 connected thereto via a threaded extension 104 adapted for receipt into a threaded bore 105 provided in the body web 96. A body insert 106 having an enlarged head 108 with a smooth bore 110 provided therethrough is adapted to fit into the open portion 98 with the shaft 30 passing through the bore 110. The lower portion of the insert 106 is provided with a downwardly extending outwardly threaded boss 112 having a central bore 114 extending therethrough and into communication with the bore 110. The bore 114 also extends upwardly into the head 108. A pair of braking element 116 each having a concave upper surface 118 is adapted to fit within the bore 114 such that they frictionally contact the surface of the shaft 30 on opposite sides. A spring assembly 120 including a spring 122 and a pair of washers 123 also is adapted to be housed within the bore 114 beneath the lower braking element 116.

A circular plate 124 having an upper surface 125 provided with degree indicia indicating the relative position of the plate vis-a-vis the handle assembly body 92 is mounted on a downwardly extending central boss 126. The boss includes a radial flange 127. A lower plate 128 is positioned below the flange 127 and connected to the upper plate 124 by screws **128*a*. By removing the screws 128*a* the relative positioning of the plates 124 and 128 is brought about. The upper surface of the plate 124 is also provided with an upwardly extending stop 129. One side 137 of the body 92 is enlarged and provided with a stop bolt 138 downwardly extending through an open threaded bore 139. The bolt extends towards the upper surface of the plate 124 to contact stop 129 to limit movement of the boss 126 vis-a-vis the body 92** to 360 degrees.

The boss 126 has an internally threaded bore 130. Such bore 130 is adapted to receive the threaded boss of the insert. The lower portion of the boss 126 is provided with a step 131 adapted to receive and support the lower washer 123 such that relative vertical movement of the boss 126 vis-a-vis the body as by rotation of the boss, forces the spring assembly and thus the braking element into engagement with the shaft 30 for progressive frictional contact therewith. The lower end of the boss includes a geometric opening 132 into which a wrench 133 such as the hexagonal wrench depicted may be inserted so as to tighten and loosen the adjustment of the upper resistance unit. The head 108 is provided with an indicator 134 outwardly extending therefrom such that the relative positioning of the two elements and thus the force exhibited on the shaft 30 may be thus preset and recorded. The boss 126 is also provided with a threaded bore 135 adapted to receive a set screw 136 such that once the proper setting and frictional engagement is achieved is may be fixed in that position by jamming the set screw 136 against the threaded boss 112.

The upper end 34 of the shaft 30 is provided with means for spacing the shaft in its lowermost lateral position a distance above the floor or other supporting surface such that the shaft preferably maintains a lateral plane parallel to or coincident with the plane of the upper surface of the bench or other supporting mechanism. Such spacing means 140 may take the form, as depicted, of a wheel permanently fixed to the upper shaft end 34 which either accomplishes its spacing result by frictional sliding on the contact surface, i.e., a floor, ground, etc., or by rolling contact therewith.

The varied operational functions of the device will now be explained by reference to the drawings and particularly FIGS. 1 through 14. In each sequence of exercise, the shoulder being exercised is placed in approximate alignment with and adjacent to the lower resistance unit, i.e., the lower end 32 and the hand of that arm grasps the hand grip projecting from the upper resistance unit. Also for each of the exercise positions, the following points will be listed from A through I, that is, A - position; B - drawing sequence; C - exercise stage; D - body positioning; E - plane of motion; F - biomechanical shoulder action, range of motion, and muscle activity; G - biomechanical elbow action, range of motion, and muscle activity; H - shaft position; and I - resistance adjustment:

A - Position 1
B - FIGS. 1, 2, 3, and reverse
C - therapeutic
D - supine on back with feet flat on floor
E - straight plane with or without rotation
F - 180 degrees of abduction/adduction with or without 180 degrees of internal/external rotation
G - The elbow is held in full extension and can move through or be fixed at any point along 180 degrees of pronation/supination
H - The shaft is horizontal with the wheel resting on floor. The wheel makes continuous contact with floor as it moves with shaft through full range of movement.
I - resistance adjustment on lower resistance system for abduction/adduction of shoulder with resistance adjustment on upper resistance system for internal/external rotation of shoulder and pronation/supination of elbow A - Position 2
B - FIGS. 4, 5 and reverse
C - therapeutic
D - supine on back with fleet flat on floor
E - straight plane (vertically up and down)
F - full range or up to 180 degrees of horizontal abduction/adduction
G - 135 degrees or full range of elbow flexion/extension
H - vertical (if more horizontal adduction is desired, the shaft is tilted over the MUEE's bench)
I - The lower resistance unit is tightened to discourage its movement. The upper resistance system is adjusted according to the needs of the extremity. Since this is considered as a therapeutic exercise, the resistance available in the upper resistance system alone will be adequate for both the shoulder and elbow as the lightest of loads will be used initially.

A - Position 3
B - FIGS. 6, 7 and reverse
C - therapeutic
D - prone on stomach
E - straight plane (horizontally up and down)
F - full range of 180 degrees of shoulder abduction/adduction while in the neutral position of internal/external rotation
G - 135 degrees or full range of flexion/extension while in a fixed position of pronation/supination or with movement through pronation/supination
H - The shaft is horizontal to the floor, aligned parallel with the bench, the wheel rests on floor and positioned away from the one exercising.
I - The lower resistance unit is tightened to discourage its movement. The upper resistance unit is adjusted according to the needs of the extremity.

A - Position 4
B - FIGS. 8, 9, 10 and reverse
C - advanced therapeutic, conditioning
D - supine on back with feet flat on floor
E - straight plane with or without rotation
F - 180 degrees of flexion/extension and 180 degrees of internal/external rotation at the shoulder
G - The elbow is held in full extension and can be moved through or be fixed at any point along 180 degrees of pronation/supination.
H - The shaft moves through 180 degrees of arc with its wheel determining the limits of motion.
I - The lower resistance unit is adjusted for flexion/extension and internal/external rotations at the shoulder. The upper resistance unit is adjusted for pronation/supination at the elbow or can be locked if elbow motion is not desired.

Figure 12:
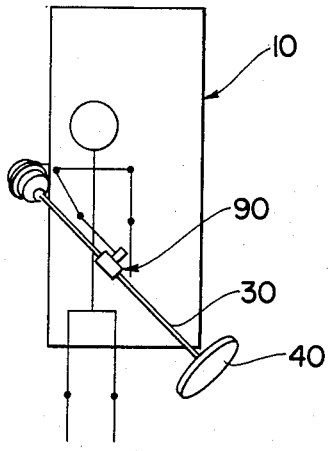

A - Position 5
B - FIGS. 2, 12 and reverse
C - advanced therapeutic, conditioning
D - supine on back with feet on floor, body movement away from lower resistance unit will increase adduction
E - straight plane with or without rotation
F - shoulder horizontal adduction/abduction with 180 degrees of internal/external rotation or fixed at any point along this range
G - The elbow is held in full extension but may move through 180 degrees of pronation/supination or be fixed at any point along this range.
H - The wheel of shaft comes in contact with the floor to determine the limit of horizontal abduction. The limit on horizontal adduction is reached when the shaft comes into contact with either the bench or person's exercising side.
I - The lower resistance unit is adjusted for flexion/extension and internal/external rotations at the shoulder. The upper resistance unit is adjusted for pronation/supination at the elbow or can be locked if elbow motion is not desired.

A - Position 6
B - FIGS. 3, 12 and reverse
C - conditioning
D - supine on back with feet flat on floor
E - diagonal
F - combined movements of extension, adduction, and internal or external rotation and flexion, abduction, and internal or external rotation
G - flexion/extension and pronation/supination
H - Multidirectional with wheel limiting abduction/flexion
I - The lower resistance unit is adjusted for the shoulder complex. The upper resistance unit is adjusted for the elbow complex.

A - Position 7
B - FIGS. 1, 11 and reverse
C - conditioning
D - supine on back with feet on floor
E - diagonal
F - combined movements of flexion, adduction, and internal or external rotation and extension, abduction, and internal or external rotation
G - flexion/extension and pronation/supination
H - multidirectional with wheel limiting abduction/extension
I - The lower resistance unit is adjusted for the shoulder complex. The upper resistance unit is adjusted for the elbow complex.

Figure 13:
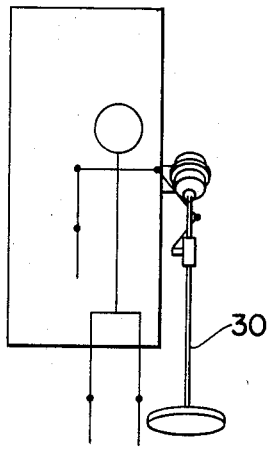
Figure 14:
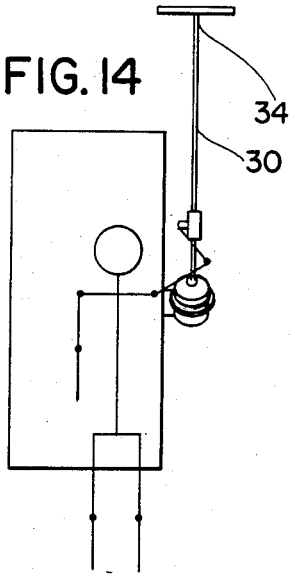
Figure 19:
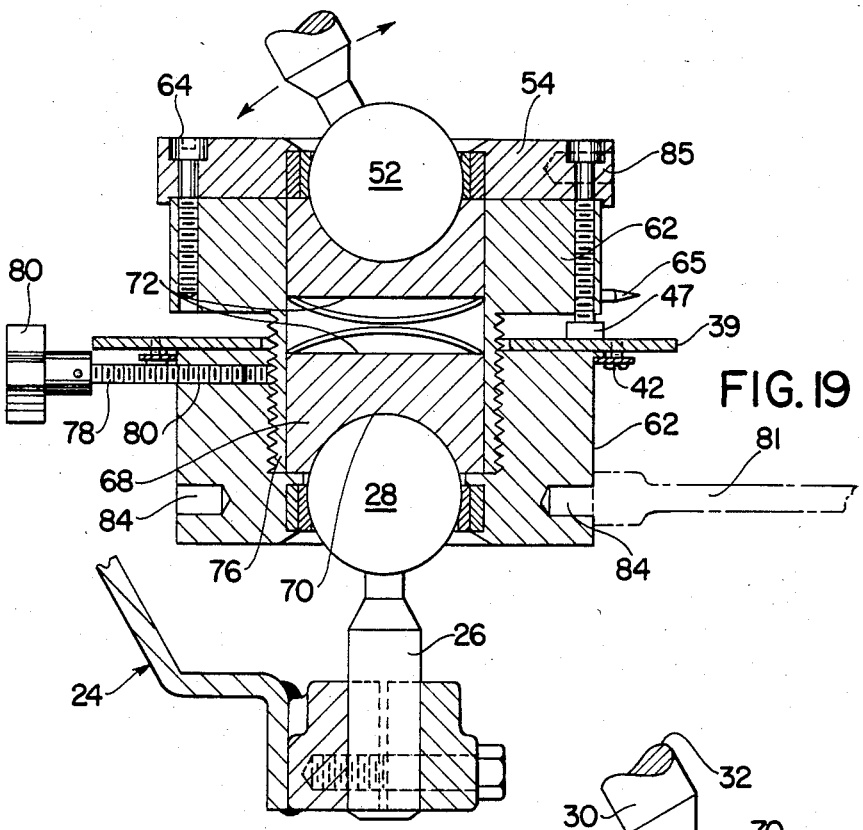
FIG. 19, is a sectional view along the lines 19—19 and in particular showing the lower resistance unit.
Figure 19A:
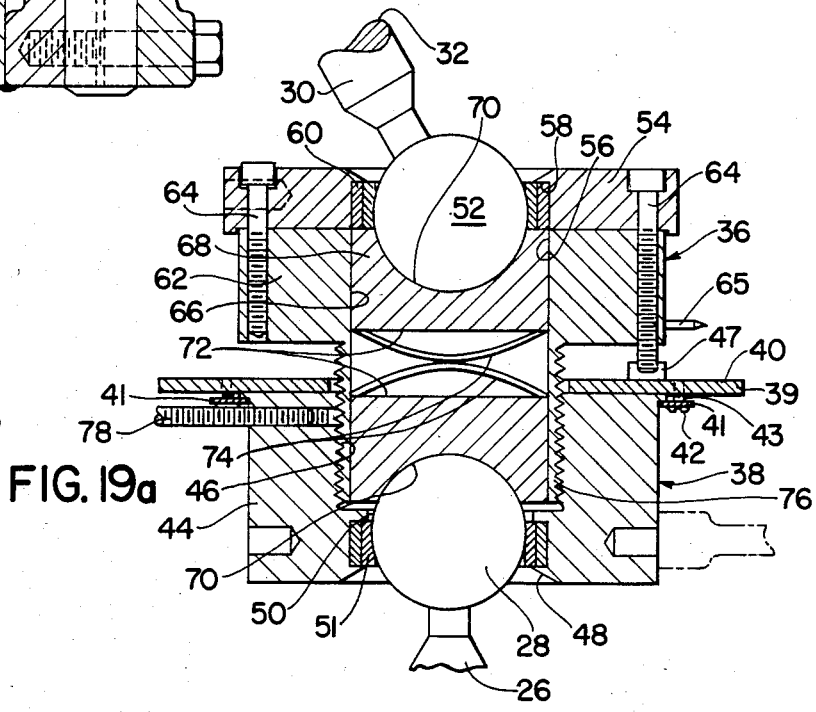
FIG. 19*a* is a sectional view similar to FIG. 19 but showing the lower segment of such lower resistance unit rotated 360 degrees such that a position of very low resistance is achieved.
Figure 18:
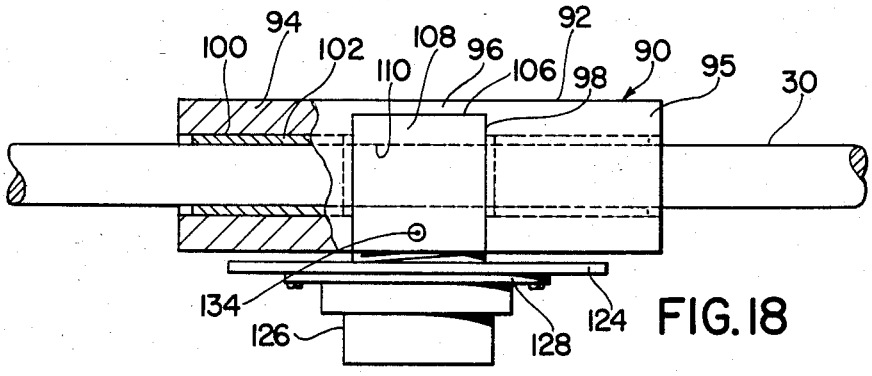
FIG. 18 is an enlarged elevational view of the handle unit with parts broken away for clarity.

A - Position 8
B - FIGS. 13, 14 and reverse
C - therapeutic
D - supine on back with feet on floor
E - straight plane F - 180 degrees of internal/external rotation
G - The elbow is positioned anywhere from 90 degrees of flexion to full extension.
H - The wheel of shaft comes into contact with the floor to determine the limits of internal and external rotation.
I - Resistance for internal/external rotation is adjusted at the lower resistance unit while the upper resistance unit is tightened to discourage elbow movement.
A - Position 9
B - FIGS. 5, 12, 1, 2, 3, 11 and reverse
C - conditioning
D - supine with feet flat on floor
E - rotational
F - circumduction clockwise or counterclockwise
G - The elbow is held in full extension. Full pronation/supination can occur if desired.
H - multidirectional
I - The lower resistance unit is adjusted for the shoulder complex. The upper resistance unit is adjusted for the elbow complex.
A - Position 10
B - FIGS. 14, 9 are an example of a throwing sport
C - specificity of sports conditioning
D - supine with feet flat on floor
E - rotational
F - unlimited but confined to that of the throwing sport being trained
G - unlimiting but confined to that of the throwing sport being trained
H - multidirectional
I - The lower resistance unit is adjusted for the shoulder complex. The upper resistance unit is adjusted for the elbow complex.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An upper extremity exercising device for use with a support for a human exerciser including a substantially planar surface for supporting one of the shoulders of the exerciser and defining a lateral plane, said exercise device comprising a rigid elongated member having upper and lower ends, means for operatively connecting said lower end with said support at a position substantially laterally adjacent said planar surface exerciser, means comprising a lower resistance unit for pivotally supporting said lower end such that said member may simultaneously transcribe arcs of substantially 180 degrees in planes substantially parallel and normal to said lateral plane, said supporting means further including means for adjusting the resistance to pivotal movement of said member such that both the human effort needed to transcribe such arcs can be progressively increased or decreased dependent on exercise requirements and the position of said member may be alternatively fixed with respect to said support, and an upper resistance unit including a handle assembly for grasping by the exerciser and supported for longitudinally slidable movement on said member intermediate the upper and lower ends thereof, said handle assembly being adapted for said slidable movement while said member simultaneously pivotally moves with respect to said support, said handle unit having means for adjusting the resistance to sliding movement on said member such that the human effort needed to move said unit can be progressively increased or decreased dependent on exercise requirements and the position of said unit may be alternatively fixed with respect to said member.

2. The device of claim 2, said supporting surface being the upper surface of a bench, said bench having opposed sides and ends and including means for attaching said member's lower end at one side thereof.

3. The device of claim 2, said member lower end attaching means generally centrally disposed between said ends of said bench.

4. The device of claim 2, said means for attaching said member's lower end including a universal joint for attaching said member lower end to said bench and floor contact means disposed at said member upper end for maintaining said member at a height essentially no lower than said lateral plane.

5. The device of claim 4, said floor contact means being a disc attached to the member end at essentially right angles to the longitudinal extent thereof, said disc adapted to contact the bench supporting floor as said member moves in said lateral plane.

6. The device of claim 1, said means for pivotally supporting said member including a universal joint having a ball frictionally supported between opposed housing segments, said housing segments adapted for relative rotation towards and away from each other to define alternative fixed positions of varying exercise effort.

7. The device of claim 2, said means for pivotally supporting said member including a universal joint having a ball frictionally supported between opposed housing segments, said housing segments adapted for relative rotation towards and away from each other to define alternative fixed positions of varying exercise effort.

8. The device of claim 6, said housing including upper and lower segments, said universal joint including a fixed first ball element outwardly extending from said bench into said lower housing segment, said member lower end terminating in a second ball element extending into said upper housing segment, said upper housing element including a brake disposed therein and in respective engagement with portions of each of said ball elements, said lower housing segment adapted to threadably receive said upper housing element and means for positively locking said housing elements together.

9. The device of claim 8, said brake including a pair of brake elements each having a rear surface and a concave front surface in turn engaging one of said ball elements and spring means disposed between rear surfaces.

10. The device of claim 9, said spring means being a pair of opposed Belleville springs.

11. The device of claim 1, said member being a shaft of circular cross-section, said handle unit additionally free for partial rotational movement with respect to said shaft in its slidable position therewith.

12. The device of claim 1, said handle unit including a body having a longitudinal bore adapted to slidably receive said member, a pair of friction brake elements mounted transversely of said bore, at least one of said brake elements adapted to move into progressively engagement with said member, and an adjustment plate threadably engaged with said body so as to urge said brake one element inwardly against said member.

13. The device of claim 12, said member being a shaft of circular cross-section, said body including a body insert forming a portion of said bore, said body insert having an outwardly extending threaded boss in turn having a hollow bore, a spring disposed in said bore behind said one friction brake element, and said adjustment plate threadably engaged with said threaded boss.

14. The device of claim 13, including means for fixing the relationship of said insert and said adjustment plate and thus the braking effect on said shaft.

15. The device of claim 13, said body of bifurcated configuration having body portions longitudinally separated by an intermediate inset, said insert including a head having a smooth bore extending therethrough for receipt of said shaft, said head disposed in said inset.

16. The device of claim 8, said handle unit including a body having a longitudinal bore adapted to slidably receive said member, a pair of friction brake elements mounted transversely of said bore and adapted to move into progressively engagement with said member, and an adjustment plate assembly threadably engaged with said body so as to urge at least one of said brake elements inwardly against said member.

17. The device of claim 6, including stop means provided in said housing segments for limiting the relative rotation of said segments with respect to each other to 360 degrees.

18. The device of claim 1, including means for indicating the adjusted motion resistance in both said upper and lower resistance units, said indicating means adapted for recalibration.

19. The device of claim 17, said upper housing segment having upper and lower ring-like portions interconnected by bolts one of which extends beyond said upper housing towards said lower segment, and stop means provided on said lower housing segment to contact said longer bolt so as to limit the relative rotation of said housing segments to 360 degrees.

20. The device of claim 16, including stop means provided on said body insert and said adjustment plate assembly for limiting the relative rotation of said adjustment plate assembly vis-a-vis said body to 360 degrees.

* * * * *